United States Patent [19]

Graves

[11] Patent Number: 4,511,106

[45] **Date of Patent: * Apr. 16, 1985**

[54] HEAT EXCHANGER SUPPORT SYSTEM PROVIDING FOR THERMAL ISOLATION AND GROWTH

[75] Inventor: Richard F. Graves, Huntington Beach, Calif.

[73] Assignee: The Garrett Corporation, Los Angeles, Calif.

[ * ] Notice: The portion of the term of this patent subsequent to May 25, 1999 has been disclaimed.

[21] Appl. No.: 293,914

[22] Filed: Aug. 14, 1981

Related U.S. Application Data

[62] Division of Ser. No. 955,117, Oct. 26, 1978.

[51] Int. Cl.[3] ..... F16L 21/00

[52] U.S. Cl. ..... 248/65; 248/49; 248/232; 285/286

[58] Field of Search ..... 248/232, 233, 234, 550, 248/DIG. 1, 55, 49, 65; 285/225, 226, 227, 229; 74/18, 18.1, 18.2

[56] References Cited

U.S. PATENT DOCUMENTS

| | | | |
|---|---|---|---|
| Re. 29,582 | 3/1978 | Brown | 74/18.2 X |
| 351,263 | 10/1886 | Hemphill | 285/225 X |
| 558,025 | 4/1896 | Barry | 285/226 X |
| 1,015,180 | 1/1912 | Heitman | 285/229 X |
| 1,380,793 | 6/1921 | Goldman | 285/226 X |
| 2,709,564 | 5/1955 | Stenner | 248/232 |
| 3,168,356 | 2/1965 | Yama | 248/232 X |
| 3,690,705 | 9/1972 | Ygfors | 403/28 |
| 3,710,853 | 1/1973 | Young | 165/81 |
| 4,331,352 | 5/1982 | Graves | 248/55 X |

FOREIGN PATENT DOCUMENTS

| | | | |
|---|---|---|---|
| 452953 | 11/1927 | Fed. Rep. of Germany | 285/226 |
| 2017358 | 4/1970 | Fed. Rep. of Germany | 248/233 |
| 2811243 | 9/1978 | Fed. Rep. of Germany | 248/232 |

OTHER PUBLICATIONS

The Oil and Gas Journal, Apr. 11, 1977, pp. 74–78.

*Primary Examiner*—William H. Schultz

*Attorney, Agent, or Firm*—Henry M. Bissell; Albert J. Miller

[57] ABSTRACT

Apparatus for supporting and constraining opposed end members of a heat exchanger frame structure while maintaining the high temperature portions of the heat exchanger thermally isolated from the frame and accommodating relative movement of the heat exchanger due to thermal growth. Thermal isolation with structural support is achieved by the use of strategically positioned, thin-walled metal members aligned in the direction of heat travel between high temperature portions of the heat exchanger and adjacent frame elements. Opposed portions of the heat exchanger are tied together by rods extending between them and secured thereto. Longitudinal growth of the heat exchanger core and associated ducting is accommodated by the provision of flange guides slidable on guide pins attached to the frame.

9 Claims, 6 Drawing Figures

HEAT EXCHANGER SUPPORT SYSTEM PROVIDING FOR THERMAL ISOLATION AND GROWTH

This is a division of application Ser. No. 955,117 filed Oct. 26, 1978.

INTRODUCTION

Heat exchangers incorporating apparatus of the present invention have been developed for use with large gas turbines for improving their efficiency and performance while reducing operating costs. Heat exchangers of the type under discussion are sometimes referred to as recuperators, but are more generally known as regenerators. A particular application of such units is in conjunction with gas turbines employed in gas pipe line compressor drive systems.

Several hundred regenerated gas turbines have been installed in such applications over the past twenty years or so. Most of the regenerators in these units have been limited to operating temperatures not in excess of 1000° F. by virtue of the materials employed in their fabrication. Such regenerators are of the plate-and-fin type of construction incorporated in a compression-fin design intended for continuous operation. However, rising fuel costs in recent years have dictated high thermal efficiency, and new operating methods require a regenerator that will operate more efficiently at higher temperatures and possesses the capability of withstanding thousands of starting and stopping cycles without leakage or excessive maintenance costs. A stainless steel plate-and-fin regenerator design has been developed which is capable of withstanding temperatures to 1100° or 1200° F. under operating conditions involving repeated, undelayed starting and stopping cycles.

The previously used compression-fin design developed unbalanced internal pressure-area forces of substantial magnitude, conventionally exceeding one million pounds in a regenerator of suitable size. Such unbalanced forces tending to split the regenerator core structure apart are contained by an exterior frame known as a structural or pressurized strongback. By contrast, the modern tension-braze design is constructed so that the internal pressure forces are balanced and the need for a strongback is eliminated. However, since the strongback structure is eliminated as a result of the balancing of the internal pressure forces, the changes in dimension of the overall unit due to thermal expansion and contraction become significant. Thermal growth must be accommodated and the problem is exaggerated by the fact that the regenerator must withstand a lifetime of thousands of heating and cooling cycles under the new operating mode of the associated turbo-compressor which is started and stopped repeatedly.

Confinement of the extreme high temperatures in excess of 1000° F. to the actual regenerator core and the thermal and dimensional isolation of the core from the associated casing and support structure, thereby minimizing the need for more expensive materials in order to keep the cost of the modern design heat exchangers comparable to that of the plate-type heat exchangers previously in use, have militated toward various mounting, coupling and support arrangements which together make feasible the incorporation of a tension-braze regenerator core in a practical heat exchanger of the type described.

Heat exchangers of the type generally discussed herein are described in an article by K. O. Parker entitled "Plate Regenerator Boosts Thermal and Cycling Efficiency", published in *The Oil & Gas Journal* for April 11, 1977.

BACKGROUND OF THE INVENTION

1. Field of the Invention

This invention relates to heat exchangers and, more particularly, to apparatus for providing thermal isolation and support of heat exchanger ducting members from the heat exchanger frame.

2. Description of the Prior Art

Arrangements are known in the prior for fastening together two different elements in a heat insulating mounting or for accommodating thermal growth between adjacent elements which are mounted together. For example, the Ygfors U.S. Pat. No. 3,690,705 discloses a device for rigidly connecting two metallic members together in heat-insulating relation. The arrangements disclosed in this patent depend upon a bushing constructed of a material having known heat insulating properties mounted between the two members.

The Young U.S. Pat. No. 3,710,853 discloses an arrangement of a radiator comprising two headers or tanks on opposite sides of a heat exchanging core. One of the tanks is fixed to the frame while the other is mounted to the frame by means of a shoulder stud extending through an enlarged hole in the frame to permit lateral movement of the stud. However, no thermal isolation of the radiator from the mounting frame is provided, the only concern being the accommodation of the different coefficients of expansion for the frame and the radiator. The arrangement of the Young patent depends upon flexible conduits, typically rubber hoses, for connection to the fluid passages of the radiator.

Devices of the type disclosed in these prior art patents may be suitable for apparatus of limited size, weight and thermal gradient. However, they are totally unsuitable for heat exchangers of the type here involved which include heat exchanger cores operating at temperatures in excess of 1000° F. supported in frames of conventional structural steel construction maintained at temperatures less than 150° F.

SUMMARY OF THE INVENTION

In brief, arrangements in accordance with the present invention comprise members for supporting heat exchanger ducts relative to the heat exchanger frame which serve to provide thermal isolation of the ducts from the associated frame members while accommodating axial and radial thermal growth and limited lateral movement. Thermal isolation with the required structural support is provided in accordance with an aspect of the invention by the use of thin walled metal members extending between the ducts and associated points of attachment to the frame. One such element is in the form of a thin walled cylinder with end plates threaded to receive mounting bolts. The cylinder is attached to a frame member (the cold structure) by a mounting bolt fitted into one end of the cylinder. The other end of the cylinder is constrained axially by means of a shoulder bolt threaded into the other end of the cylinder and extending through an oversized opening in a flange attached to the heat exchanger duct (the hot structure). This opening may be a radially aligned slot in the flange or a round opening larger than the body of the bolt but small enough to be engaged by the bolt head or a retaining washer mounted thereon. The threaded portion of the shoulder bolt is of lesser diameter than the shoulder portion, thereby insuring sufficient space between the end of the thin walled cylinder and the retaining portion (head or washer) to permit the duct flange to slide radially relative to the cylinder. Although the cylinder is of metal for structural strength, the thin walls of the cylinder have low thermal conductivity, thus providing the desired thermal isolation between the hot and cold structures.

Further thermal isolation with accommodation of thermal growth of the hot structure is also provided by circumferential bellows members having re-entrant collar portions developing an extended path length for heat travelling through the metal between the hot and cold structures. Duct flange members at opposite ends of the heat exchanger are provided for supporting the duct loading of attached piping and for balancing the internal pressure forces relative to the frame. These are tied together for dimensional stabilization of the heat exchanger by means of tie rods which extend through the space surrounding the heat exchanger core. Support pins extending through openings in ears or projections on the manhole flanges covering the blind ducts at the rear end of the heat exchanger serve to support these flanges and ducts while permitting several inches of axial growth of the core structure and internal duct passages connected thereto.

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENTS

Figure 1:
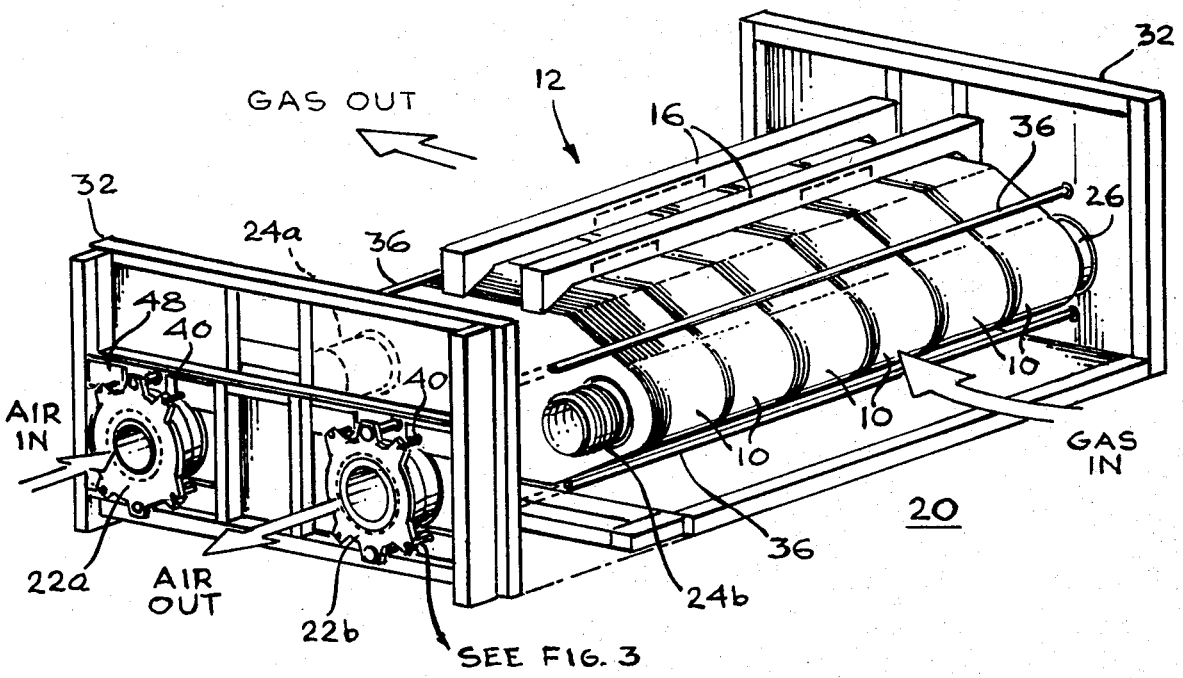
FIG. 1 is a perspective, partialy exploded view of a heat exchanger module in which embodiments of the present invention are utilized.
Figure 2:
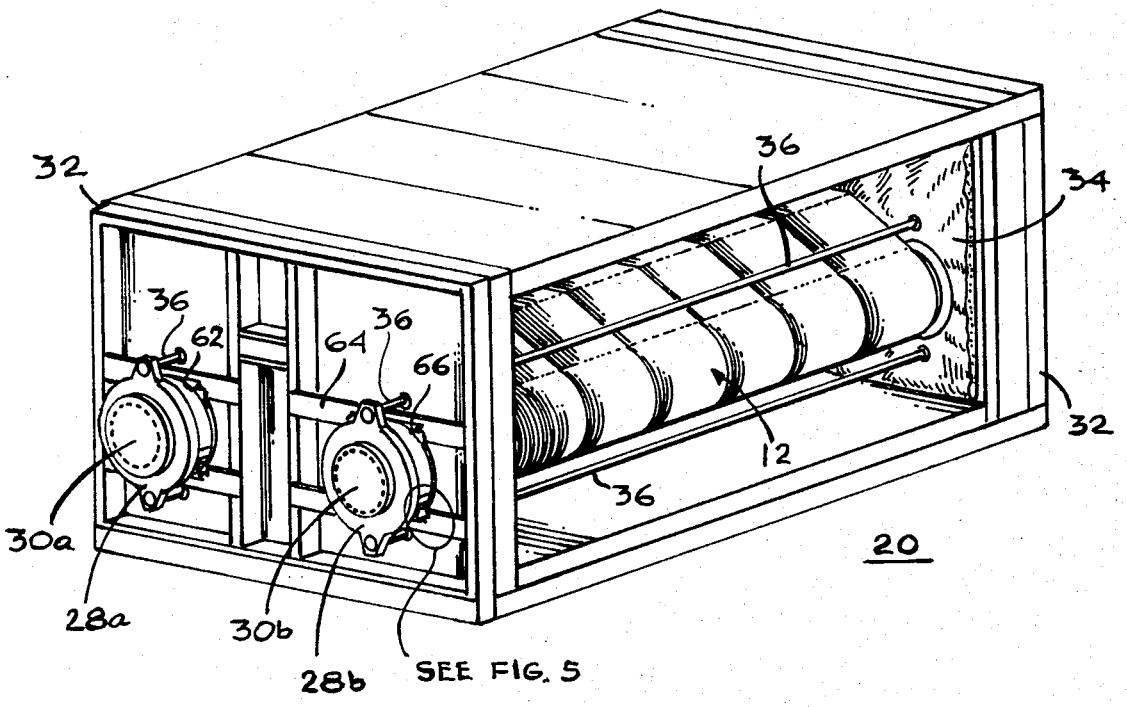
FIG. 2 is a perspective view of the heat exchanger module of FIG. 1, taken from the opposite end.

As presently constructed, heat exchangers utilizing arrangements in accordance with the present invention are fabricated of formed plates and fins assembled in sandwich configuration and brazed together to form core sections. These sections 10 are assembled in groups of six (referred to as "six-packs") as shown in FIGS. 1 and 2 to form a core 12 which, together with associated hardware, comprises a single heat exchanger module 20. A single module 20 may be joined with one or more other modules to make up a complete heat exchanger of desired capacity.

In the operation of a typical system employing a regenerator of the type discussed herein, ambient air enters through an inlet filter and is compressed to about 100 to 150 psi, reaching a temperature of 500° to 600° F. in the compressor section of an associated gas turbine (not shown). It is then piped to the regenerator module 20, entering through the inlet flange **22*a* (FIG. 1) and inlet duct 24*a*. In the regenerator module 20, the air is heated to about 900° F. The heated air is then returned via outlet duct 24*b* and outlet flange 22*b* to the combustor and turbine section of the associated turbine via suitable piping. The exhaust gas from the turbine is at approximately 1100° F. and essentially ambient pressure. This gas is ducted through the regenerator 20 as indicated by the arrows labelled "gas in" and "gas out" (ducting not shown) where the waste heat of the exhaust is transferred to heat the air, as described. The exhaust gas drops in temperature to about 600° F. in passing through the regenerator 20** and is then discharged to ambient through an exhaust stack. In effect, the heat that would otherwise be lost is transferred to the inlet air, thereby decreasing the amount of fuel that must be consumed to operate the turbine. For a 30,000 hp turbine, the regenerator heats 10 million pounds of air per day.

The regenerator is designed to operate for 120,000 hours and 5000 cycles without scheduled repairs, a lifetime of 15 to 20 years in conventional operation. This requires a capability of the equipment to operate at gas turbine exhaust temperatures of 1100° F. and to start as fast as the associated gas turbine so there is no requirement for wasting fuel to bring the system on line at stabilized operating temperatures. The use of the thin formed plates, fins and other components making up the brazed regenerator core sections contributes to this capability. However, it will be appreciated that there is substantial thermal growth in all three dimensions as a result of the extreme temperature range of operation and the substantial size of the heat exchanger units. As an example, the overall dimensions for the module 20 shown in FIGS. 1 and 2, in one instance, were 17 feet in width, 12 feet in length (the direction of gas flow) and 7.5 feet in height.

The core 12 is suspended from beams 16 by a suspension system which permits this thermal growth. Also, coupling is provided between the manifold duct portions **24*a*, 24*b* and the inlet and outlet flanges 22*a*, 22*b* by apparatus which isolates the external pipe loads at the flanges 22*a*, 22*b* from the heat exchanger core 12** while accommodating the thermal growth as described.

As indicated, particularly in FIG. 2, somewhat similar flange and duct arrangements are provided at the end of the module 20 opposite the air flanges **22*a*, 22*b* and ducts 24*a*, 24*b*. These comprise blind ducts such as 26 (FIG. 1) and manway flanges 28*a*, 28*b* with manhole covers 30*a*, 30*b*, and are provided for balancing the internal pressure forces on the manifold portions of the core 12 by means of tie rods 36 and to permit access to the manifold sections of the core 12** for inspection and maintenance.

The frame is maintained in thermal isolation from the heat exchanger core 12 and associated components which are operated at elevated temperatures to levels in excess of 1000° F. in a manner which insures that the temperature of the frame will not exceed 140° on a 100° day, thus permitting the frame to be constructed of low-cost structural steel while limiting the requirement for special high temperature materials essentially to the heat exchanger core 12.

It will be appreciated that the highest temperature in the module 20 is at the gas inlet side of the chamber surrounding the core 12. This chamber is thoroughly insulated by blankets and blocks of insulation, such as the insulation blanket 34 (FIG. 2). While this chamber contains exhaust gas at a pressure at or slightly above ambient, it will be appreciated that all parts of the frame 32 must be protected against possible leaks past the thermal blanket insulation 34 which might permit hot exhaust gas to escape and reach any portion of the frame 32.

The flanges 22*a*, 22*b* are fixed in position relative to the frame 32 and thermal growth is permitted to extend in the direction from left to right in the module as shown in FIG. 1. The pressure forces developed by the compressed air within the manifold portions of the core 12 are contained by tie rods 36 which extend through the gas chamber and fasten at opposite ends to the flanges 22*a*, 22*b*, 28*a*, and 28*b* as shown. However, since these tie rods 36 are of substantial length, approximately 18 feet, with the major portion of their length extending within the hot exhaust gas chamber, the tie rods 36 also experience thermal growth and provision must be made to accommodate this growth at the blind duct/manway flange end of the module 20 while providing the necessary support from the frame 32 of the weight of the structure at that end.

Figure 3:
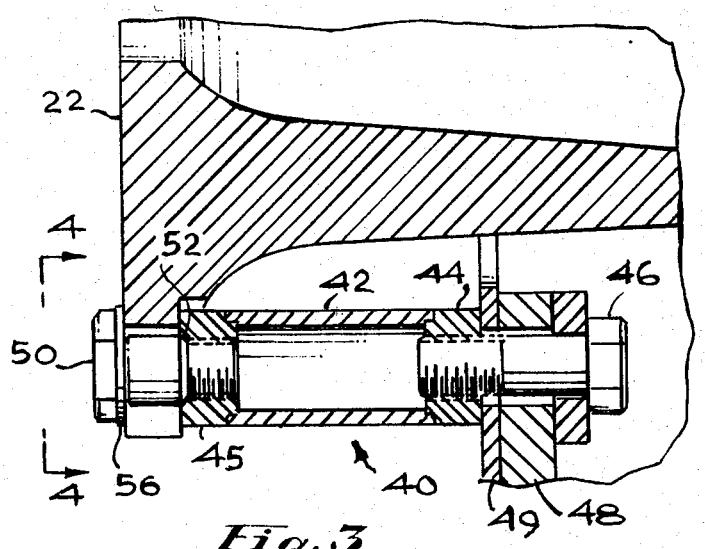
FIG. 3 is a sectional view of a portion of the heat exchanger module of FIGS. 1 and 2, illustrating one embodiment of the invention.

As noted above, the air leaving the regenerator module 20 through outlet flange 22*b* is at approximately 900° F. Thus the flange 22*b* is also close to this temperature. The flange is mounted to the adjacent structure of the frame 32 by means of thermal isolators 40, such as are shown in FIG. 3. Four such thermal isolators 40 are provided for each of the flanges 22*a* and 22*b*, spaced approximately 90° apart about the flanges 22*a*, 22*b*.

Figure 4:
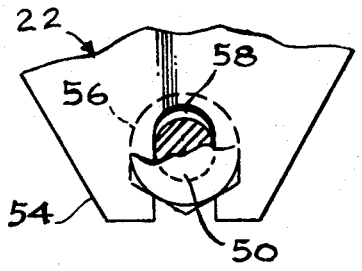
FIG. 4 is a view, partially broken away, taken along the line 4—4 of FIG. 3 and looking in the direction of the arrows.

As particularly shown in FIGS. 3 and 4, the thermal isolator 40 comprises a thin-walled cylinder 42 fastened to end portions 44, 45, as by brazing or welding. The end portion 44 is threaded to receive a mounting bolt 46 extending through a frame member 48 and a plate 49 welded to the frame member 48. This is the cold end of the thermal isolator 40 and is rigidly affixed to the frame.

At the opposite end of the thermal isolator 40, the closed end portion 45 is threaded to receive a shoulder bolt 50 having a shoulder portion 52 which bears against the end portion 45 as the bolt 50 is threaded into the end portion 45 and prevents further tightening of the bolt 50 in the threaded opening, thus maintaining a selected minimum spacing between the head of the bolt 50 and the end portion 45.

The flange 22*i* provided with a slotted projection of ear 54 (FIG. 4) to receive the bolt 50. The minimum spacing between the head of the bolt 50 and the thermal isolator end portion 45 is sufficiently greater than the thickness of the ear 54 at this point to accommodate a washer 56 and maintain a gap of not less than 0.005 inches. Moreover, the positioning of the thermal isolator 40 on the frame member 48 relative to the flange 22 is such that a radial gap 58 of not less than 0.20 inches is maintained. This arrangement provides the desired support of the flange 22 with thermal isolation relative to the frame member 48 while accommodating radially directed thermal growth of the flange 22. That is, the flange 22 may expand radially outward to reduce the gap 58 as the flange 22 rises in temperature while the ear portion 54 slides relative to the bolt 50 and washer 56. Similar movement in the reverse direction is permitted as the flange 22 cools down after shutdown of the associated turbine.

Figure 5:
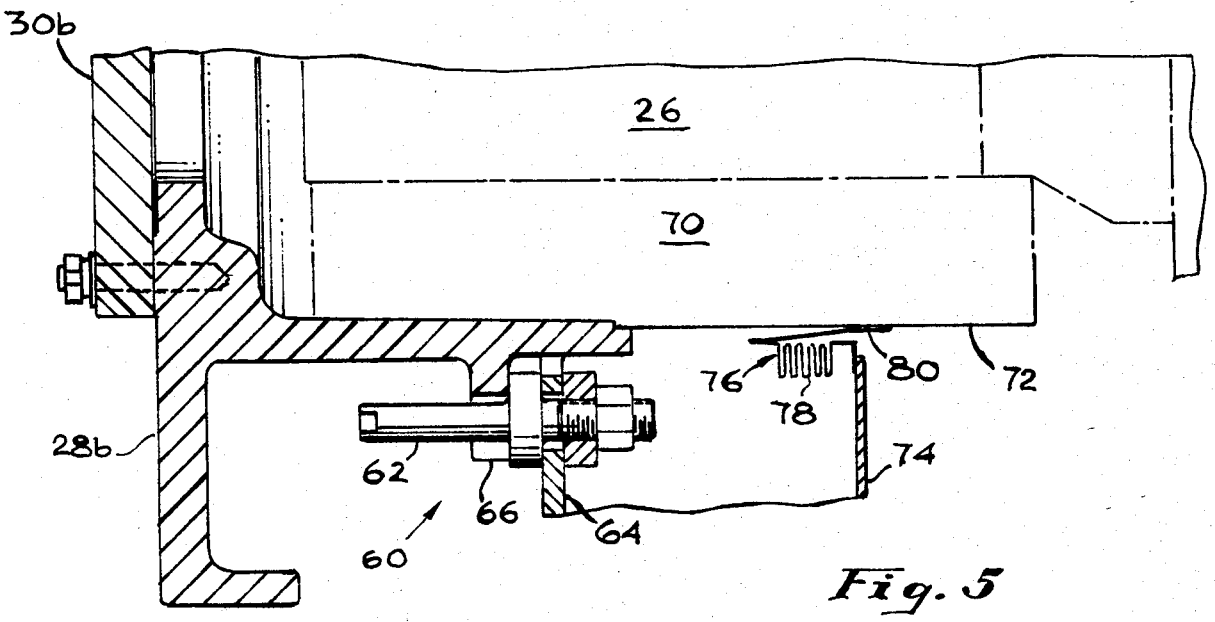
FIG. 5 is a sectional view of a portion of the module of FIGS. 1 and 2, showing details of another embodiment of the present invention.

Referring to FIG. 5, this is a sectional view taken in the vicinity of the circle inset in FIG. 2. It shows a support arrangement 60 for supporting the manway flange 28*b* whle accommodating thermal growth from the longitudinal expansion of the tie rods 36. This support arrangement 60 is represented in FIG. 5 as comprising a support pin 62 mounted on a frame member 64. A slotted extension 66 of the manway flange 28*b* encompasses the support pin 62 and moves outwardly (to the left) along the support pin 62 as the tie rods 36 extend in length due to thermal growth. Four such support arrangements 60 are provided for each of the flanges 28*a*, 28*b*, spaced at approximately 90° intervals about the periphery of the flange. Radial thermal growth is accommodated in a fashion similar to the forward end although temperature differences are somewhat less.

Also shown in FIG. 5 is a portion of the blind duct 26 suspended within a circumferential duct housing 70. The exterior surface 72 of the circumferential housing 70 is exposed, about its right-hand end as shown in FIG. 5, to the interior gas chamber of the module. A frame member 74 is shown adjacent this exterior surface 72 and insulation, such as the insulation 34 (FIG. 2), is placed in this region, but it has been omitted in FIG. 5 for simplicity. The space between the frame member 74 and the duct housing surface 72 is sealed by the circumferential member 76 which is shown comprising a bellows portion 78 and a collar portion 80. The collar portion 80 is a thin sheet fastened to the exterior surface 72 at one end and attached to the metal corrugated or bellows portion 78 at its other end. The bellows portion is joined to the frame member 74 at an end remote from its juncture with the collar portion 80. With the configuration as shown, the sealing member 76 provides thermal isolation between the duct housing surface 72 and the frame member 74 by virtue of being of thin metal cross-section and extended path length for heat which may be carried by this member. At the same time, the bellows portion 78 permits the member to accommodate the movement of the duct housing due to thermal growth of the tie rods 36. It also serves to accommodate radial thermal growth of the duct housing 70 and its external surface 72 as well as a certain amount of transverse displacement of the duct 26 and duct housing 70 relative to the axis thereof, all without any disruption of the sealing function performed by this thermally isolating, sealing member 76.

Figure 6:
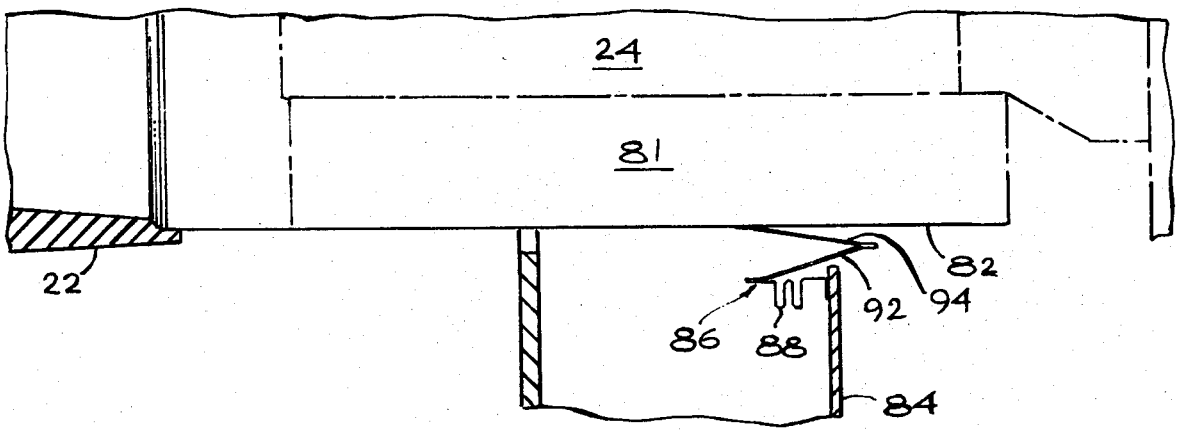
FIG. 6 is a sectional view of another portion of the module of FIGS. 1 and 2, showing details of still another arrangement in accordance with the present invention.

A similar arrangement, shown in FIG. 6, is provided for the air ducts 24*a*, 24*b* at the other end of the heat exchanger core 12. FIG. 6 is a sectional view comparable to the view of FIG. 5, but depicting an air duct 24 with its suspension housing 81 and external housing surface 82. The space between adjacent frame member 84 and the external surface 82 is sealed with a thermally isolating sealing member 86 which is shown comprising a corrugated or bellows portion 88 and a wishbone-shaped portion 90 formed of a pair of conical sheets 92 and 94. The member 86 is a circumferential structure which encircles the duct 24 and the duct housing 81 with the plate 94 being attached at one edge to the exterior housing surface 82. Member 86 accommodates axial movement of the duct housing 82 relative to the frame member 84 as well as axial displacement and radial growth of the duct 24 and duct housing 81, while at the same time maintaining the desired thermal isolation between the hot structure of the surface 82 and the frame member 84 by virtue of the extended path length of the member 86.

As thus described, the arrangements in accordance with the present invention advantageously provide support with thermal isolation of various portions of a heat exchanger which is subject to extreme operating temperatures and repeated cycling between full operation and shutdown. The thermal isolation afforded by these arrangements in accordance with the present invention is such that the associated frame structure is maintained below a maximum temperature of approximately 140° F., well within acceptable temperatures for any metal suitable as frame structure. Particular thermal isolators in accordance with the present invention serve to transmit support loads from a hot component to the cold support structure. The isolator reduces the temperature rise, and the attendent decrease in strength, of the cold structure using a thin-walled cylinder of low thermal conductivity to restrict heat flow. These arrangements in accordance with the invention are adapted to accommodate thermal growth and anticipated displacement of the hot structures being supported, relative to the associated support frame members.

Although there have been shown and described herein specific arrangements of a heat exchanger support system providing for thermal isolation and growth in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A thermally isolating member for joining a high temperature component to a support structure with minimal heat transfer comprising:

a circumferential member having a thin metal wall to restrict the heat flow; and means for connecting the thin-walled member at opposite ends respectively to the high temperature component and the support structure, said means further including means for accommodating relative movement from thermal growth of the high temperature component;

the circumferential member comprising a thin-walled wishbone-shaped member in combination with a circumferential bellows portion which is attached to the support structure, the bellows portion being aligned generally parallel to the axis of the high temperature component, extending circumferentially about said component, and being spaced therefrom, the wishbone-shaped member formed of two thin-walled metal collar portions joined together along a common edge, the opposite edges thereof being connected respectively to the high temperature component and to the circumferential bellows portion at a point remote from the support structure.

2. The device of claim 1 wherein the thin-walled wishbone-shaped member is mounted about the high temperature component, radially inward from the bellows portion, and bridges the space between the bellows portion and the high temperature component.

3. The device of claims 1 or 2 further comprising additional support means mounted between the support structure and the high temperature component for supporting and maintaining alignment of the high temperature component while accommodating relative displacement thereof due to thermal growth.

4. The device of claim 3 wherein the additional support means comprises an axially directed pin mounted on a frame member of the support structure and extending through an opening in a flange coupled to the high temperature component.

5. The device of claim 4 wherein said pin includes means for limiting movement of the flange toward the frame member while permitting movement of the flange along the pin in a direction away from the frame member.

6. The device of claim 4 wherein the additional support means comprise a plurality of said pins and flange openings spaced substantially equidistantly about the flange periphery.

7. The device of claim 4 wherein the additional support means comprise four pins and flange openings spaced approximately 90° about the flange periphery near the extreme end of the high temperature component.

8. A thermally isolating member for joining a high temperature component to a support structure with minimal heat transfer comprising:

a circumferential member having a thin metal wall to restrict the heat flow;

means for connecting the thin-walled member at opposite ends respectively to the high temperature component and the support structure, said means further including means for accommodating relative movement from thermal growth of the high temperature component;

the circumferential member comprising a thin-walled wishbone-shaped member in combination with a circumferential bellows portion which is attached to the support structure, the wishbone-shaped member formed of two thin-walled metal collar portions joined together along a common edge, the opposite edges thereof being connected respectively to the high temperature component and to the circumferential bellows portion at a point remote from the support structure; and additional support means mounted between the support structure and the high temperature component for supporting and maintaining alignment of the high temperature component while accommodating relative displacement thereof due to thermal growth.

9. The device of claim 8 wherein the additional support means comprises an axially directed pin mounted on a frame member of the support structure and extending through an opening in a flange coupled to the high temperature component.

* * * * *